United States Patent [19]

Schimko

[11] Patent Number: 4,660,391

[45] Date of Patent: Apr. 28, 1987

[54] NEEDLE SELECTION DEVICE FOR A FLAT KNITTING MACHINE

[75] Inventor: Reinhold Schimko, Aalen-Wasseralfingen, Fed. Rep. of Germany

[73] Assignee: Universal Maschinenfabrik Dr. Rudolf Schieber GmbH & Co. KG, Fed. Rep. of Germany

[21] Appl. No.: 881,743

[22] Filed: Jul. 3, 1986

[30] Foreign Application Priority Data

Jul. 4, 1985 [DE] Fed. Rep. of Germany ..... 3523997

[51] Int. Cl.[4] ..... D04B 7/00

[52] U.S. Cl. ..... 66/75.1

[58] Field of Search ..... 66/75.2, 219, 221

[56] References Cited

U.S. PATENT DOCUMENTS

| | | | |
|---|---|---|---|
| 2,157,989 | 5/1939 | Lawson | 66/75.2 |
| 3,518,845 | 7/1970 | DeCerjat | 66/75.2 |
| 3,974,664 | 8/1976 | Erb | 66/75.2 |
| 4,281,523 | 8/1981 | Schimko | 66/75.2 |
| 4,414,806 | 11/1983 | Schimko | 66/75.2 |

FOREIGN PATENT DOCUMENTS

| | | | |
|---|---|---|---|
| 2412497 | 9/1975 | Fed. Rep. of Germany | 66/75.2 |
| 1477890 | 6/1977 | United Kingdom . | |
| 1554437 | 10/1979 | United Kingdom . | |
| 1564985 | 4/1980 | United Kingdom . | |

*Primary Examiner*—Ronald Feldbaum

*Attorney, Agent, or Firm*—Sughrue, Mion, Zinn, Macpeak & Seas

[57] ABSTRACT

A needle selection device for a flat knitting machine with knitting needles which are pivotable into different positions comprises pivotable double-armed check levers which are associated with the respective needle channels along the length of the needle bed, the check levers each being pivotable by means of an electromagnet at the respective needle selection positions. In order to achieve a construction for the needle selection device which is compact, operationally reliable and has low maintenance requirements, the check levers are made of magnetically conductive material, permanent magnets are arranged on the carriage spaced in the direction of travel of the carriage and in alignment with the upper and lower lever arms of the check levers in such a way that the check levers are held by these permanent magnets in one or other of their two pivot positions, and the electromagnet is constructed and arranged in such a way that its pole shoes are arranged, at least on one lever arm side of the check levers, in the space between the poles of the corresponding permanent magnets.

7 Claims, 10 Drawing Figures

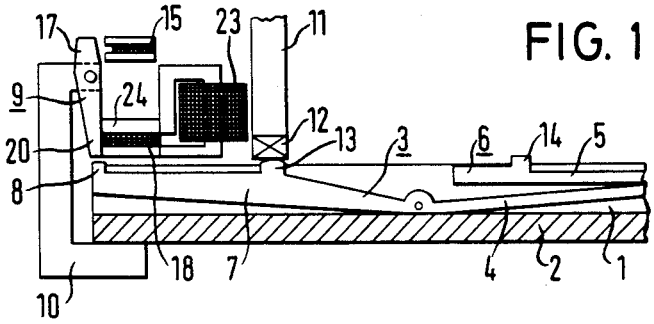
FIG. 1
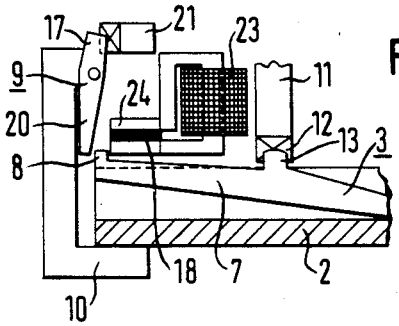
FIG. 4
FIG. 2
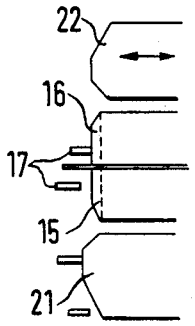
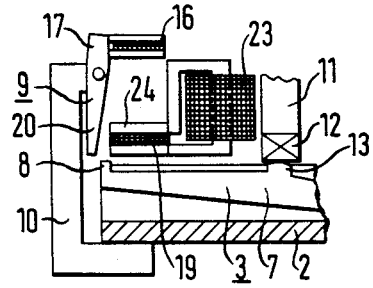
FIG. 5
FIG. 3
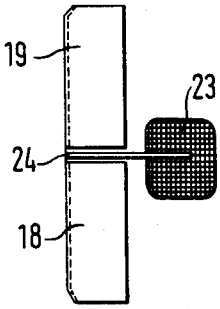
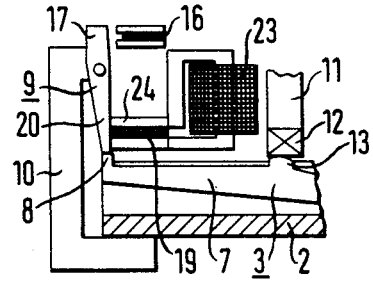
FIG. 6

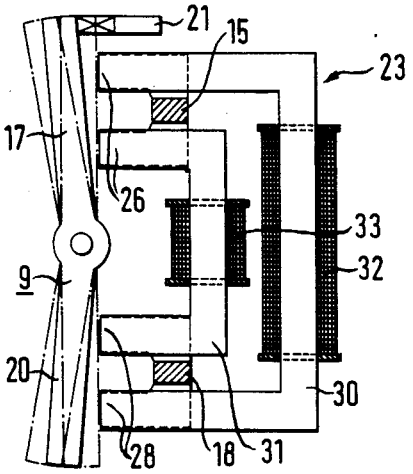
FIG. 7
FIG. 9
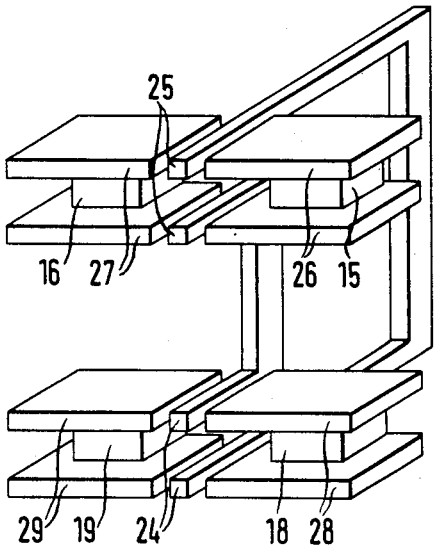
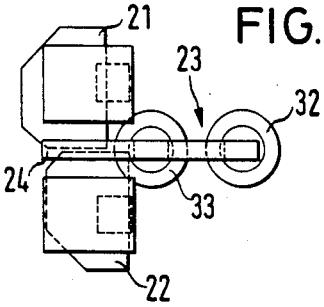
FIG. 8
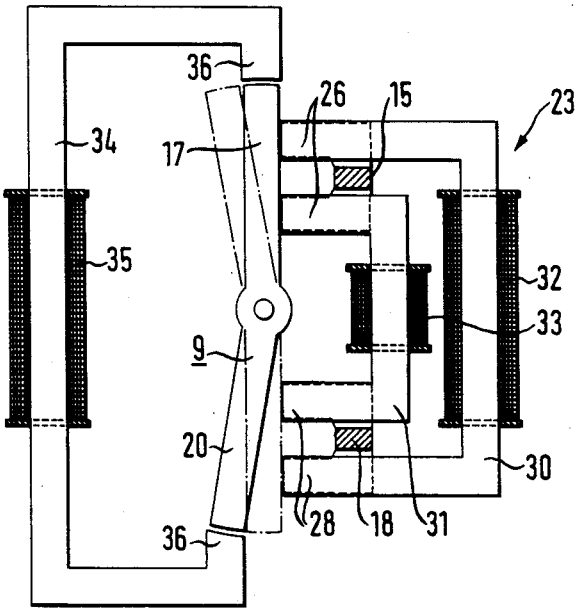
FIG.10

NEEDLE SELECTION DEVICE FOR A FLAT KNITTING MACHINE

FIELD OF THE INVENTION

This invention relates to a needle selection device for a flat knitting machine equipped with jacquard mechanism in which knitting needles are pivotable in controlled manner into different positions for needle displacement with the aid of cam means on the carriage, the selection device comprising double-armed pivotable check levers of magnetically conductive material associated with the respective needle channels and aranged spaced along the length of the needle bed substantially perpendicular to the needle bed, cam means displaceably mounted on the carriage for pivoting the check levers each into a first position, electromagnet means on the carriage for pivoting the check levers each into a second position at respective selection positions, wherein the setting of each check lever determines the pivot position of the associated knitting needle, and permanent magnet means arranged on the carriage in alignment with the two lever arms of the check levers.

In order to produce different knitting patterns on knitting machines, a needle selection device is necessary by means of which the knitting needles can be selectively controlled in such a way that, in a row of knitting, they remain out of action, knit stitches or form tuck loops. Furthermore, the needles can be selected also for the donation and acceptance of stitches.

Known needle selection devices incorporate pattern drums equipped with jacks, by means of which either selection jacks or the needles themselves are controlled directly. Alternatively, the use of steel cards is known which, according to how they are stamped out, displace pattern cams into the needle channels in the direction of the needles, which is referred to as displacement-jacquard. In the case of lift-jacquard, the needles or pattern jacks are lifted from below, so that, according to the stamping out of the steel cards, the desired needle butts or pattern jack butts come into the cam zone.

Electric needle selection devices with several electromagnets and permanent magnets on the carriage are also known, which attract selection cams along the length of the needle channel as the carriage traverses in the one or other direction, wherein the electromagnets are controlled according to the needle spacing.

A needle selection device of the type first referred to above is also known from DE-A-3226193. In this device the pivotable check levers which are arranged substantially vertically are pivoted at the selection positions by cam elements on the carriage, or by an electromagnet, into their two end positions. The permanent magnets are arranged actually at the selection positions in such a way that they prevent any post-vibration of the check levers upon their pivotal movement by the electromagnets.

Finally, there is known from DE-A-2522699 a needle selection device on a circular knitting machine in which pivotable, jack-type selection elements are arranged in the needle channels of the rotating needle cylinder, are pivoted exclusively by permanent magnets mounted on a stationary cam sleeve, and are held thereby, and for needle selection are pivoted selectively by electromagnets on the cam sleeve. The selection elements for their part pivot forked jacks directly and these move cams into the needle channels of the needle cylinder.

SUMMARY OF THE INVENTION

It is an object of the present invention to provide a needle selection device of the type first referred to above which, in comparison with the known devices, is substantially more reliable, substantially stronger and substantially more certain in the selection of the needles.

This object is achieved in accordance with the present invention, in a needle selection device of the type first referred to above, in that the permanent magnet means comprises four permanent magnets arranged in pairs each with two poles spaced in the direction of travel of the carriage with an intermediate space between the poles in the direction of travel of the carriage, in which the check levers are held by the permanent magnets in one of said first and second pivot positions, and in which the electromagnet means is constructed and arranged such that it has pole shoes arranged at least on one lever arm side of the check levers in said intermediate space between the poles of the corresponding permanent magnets.

With this construction, the check levers, upon carriage traverse, are brought by the shiftable cam means first into a position in which they are held magnetically by the permanent magnets on the one lever arm side. Depending upon whether the electromagnet means is energised at a particular selection position or not, the check lever at that position remains in its initial position or else is pivoted into another position by short-term action of the electromagnet means, in which other position it is then held by the permanent magnets acting on the other lever arm side at least so long as that position is without significance for the subsequent needle selection. By means of the construction according to the present invention one achieves a very compact and operationally reliable needle selection device, as well as one which operates with very little need for maintenance, and in which the actual needle selection (setting of the check levers in the needle selection zone) can be carried out purely magnetically with just one electromagnet.

Preferably, the electromagnet means is constructed and arranged in such a way that it has pole shoes arranged on both lever arm sides of the check levers between pole shoes of the permanent magnets. By this means, in a simple way, the action of the electromagnet means is amplified for the same power input, since the electromagnet means acts in the repelling sense on the one lever arm and in the attracting sense on the other lever arm.

The lever arms of the check levers are preferably constructed in such a way that they have surfaces confronting the permanent magnet pole shoes and extending parallel to the opposing surfaces of the permanent magnet pole shoes in the position of the check levers where they are attracted to the permanent magnets. Consequently, the holding force of the permanent magnets exerted on the check levers is optimally utilised.

The electromagnet means is preferably provided with two yokes, arranged one inwardly of the other, and with each yoke having an energising coil. In this way the compact construction of the needle selection device is yet further enhanced.

According to one preferred embodiment of the invention, the electromagnet means is also provided with a further yoke which has a further energising coil and which defines additional pole shoes between which the end surfaces of the check levers move. The lengthwise magnetisation of the check levers resulting from this arrangement supplements the rapid action of the electromagnet in the actual needle selection operation.

Preferably, the check levers are pivotable into their release positions by the electromagnet means. Then, by traverse of the carriage over the needle bed, the check levers are displaced into action by the forward movement of the cam means provided for this purpose and pivot into their blocking positions. If, at a particular selection position, the corresponding knitting needle is to be chosen, then the electromagnet is not energised at this selection position, the associated check lever remains in its blocking position and thus causes the associated knitting needle to remain in the position selected for operation. If on the other hand the electromagnet is energised at the selection position, then it repels the corresponding lever arm of the check lever and this pivots into its release position in which it is held by the permanent magnets which are in alignment with the other lever arm. The associated knitting needle is then not chosen for use.

The needle selection device of the present invention can also be formed in such a way that the check levers are pivotable into their blocking positions by the electromagnet. With such an arrangement the check levers are pivoted into their release positions by pivoting of the check levers following advancing movement of the cam means, and the energisation of the electromagnet is effected at the selection positions so that the associated check levers are pivoted into their blocking positions. Consequently, the associated knitting needles are selected for operation.

BRIEF DESCRIPTION OF THE DRAWINGS

The invention will now be described in more detail with reference to a number of preferred embodiments which are given by way of example and which are shown in the drawings. In the drawings:

FIG. 1 is a cross-sectional view through a needle bed, taken along the length of a needle channel, and partly illustrating the associated carriage with a needle selection device according to the invention, the illustration showing the carriage position shortly before needle selection;

FIG. 2 is a plan view of the shiftable cam units and permanents magnets of a needle selection device according to FIG. 1 positioned opposite the upper lever arms of the check levers;

FIG. 3 is a plan view of the permanent magnets and electromagnet of the needle selection device of FIG. 1 positioned opposite the lower lever arms of the check levers;

FIG. 4 is a partial view of the embodiment shown in FIG. 1, but with the carriage positioned before the beginning of the forward pivoting of the check lever into its blocking position;

FIG. 5 is a partial view of FIG. 1 with the check lever pivoted by the electromagnet into its release position;

FIG. 6 is a partial view of FIG. 1 with the check lever in its active blocking position;

FIG. 7 is a schematic sectional side view showing one exemplary arrangement of permanent magnet and electromagnet including the check lever;

FIG. 8 is a view from below of the arrangement shown in FIG. 7;

FIG. 9 is a schematic isometric view of the magnet frame which holds the permanent magnets and electromagnet; and, FIG. 10 is an illustration similar to FIG. 7 but showing an additional yoke and additional energising coil for the electromagnet.

DESCRIPTION OF THE PREFERRED EMBODIMENTS

In the flat knitting machine which is shown in FIGS. 1 to 6 and which is provided with a needle selection device in accordance with the invention, a tilt lever 3 is pivotally mounted at the lower end of each needle channel 1 of a needle bed 2. Each tilt lever 3 comprises a true lever arm 4 which is positioned below the flexible needle shank 5 of the associated knitting needle 6 which is displaceably mounted in the needle bed 2. The other lever arm 7 of the tilt lever 3 is provided with a nose 8 which is located below a check lever 9 of magnetically conductive material which is shown in FIG. 1 in its blocking position.

A rib 10 is fixed on the needle bed 2, and the individual check levers 9 associated with the respective tilt levers are pivotably mounted substantially upright in vertical planes in the direction of the needle channels 1. Each needle channel 1, and therefore each tilt lever 3, has a check lever 9 associated with it. For an E10 gauge, the spacing from one check lever 9 to the adjacent check lever 9 is therefore 2.54 mm.

On the carriage is mounted a pressure cam unit 11 with a leading run-on sloping cam surface 12 which comes into contact with a butt 13 on the lever arm 7 of the tilt lever 3. A needle cam unit which is not shown but which likewise is mounted on the carriage is arranged to come into engagement with a needle butt 14 on the knitting needle 6.

Also on the carriage, on each side of the actual selection position in the direction of travel of the carriage, there are fitted respective permanent magnets 15 and 16 which are positioned in alignment with the upper lever arms 17 of the check levers 9, as well as respective permanent magnets 18 and 19 which are positioned in alignment with the lower lever arms 20 of the check levers 9. Additionally, on the carriage, in alignment with the upper lever arms 17 of the check levers 9, on each side of the actual selection position, there are fitted respective cam units 21 and 22 which are each displaceable forwardly into action and rearwardly out of action, and which in their forward advanced position cause the upper lever arms 17 of the check levers 9 to be pivotably displaced by engagement therewith.

Finally, there is also mounted on the carriage an electromagnet 23 having its pole shoes 24 arranged at the actual selection position between permanent magnets 18 and 19. The electromagnet 23 is mounted with its pole shoes 24 in such a position that the check levers 9 are pivotable into the release position by energisation of the electromagnet.

The cam units 21 and 22 come into engagement with the upper lever arms 17 of the check levers 9 and pivot these check levers into a position in which the lower lever arms 20 of the check levers 9 are held by the permanent magnets 18 and 19 in one position, which is the blocking position as shown in FIG. 1. If, at any given selection position, the electromagnet 23 is energised, then the lower lever arm 20 of the corresponding check lever 9 is repelled so that the check lever 9 pivots into its release position in which it is held, by means of its upper lever arm 17 and permanent magnets 15,16, at least until its position for the needle selection no longer has any significance. This check lever 9 is held in this release position until the tilt lever 3 has been released by the pressure cam unit 11 (FIG. 4) and its nose 8 can pivot upwards. If on the other hand the electromagnet 23 is not energised at any particular selection position, then the permanent magnets 18 and 19 hold the corresponding check lever 9 in the blocking position until the pressure cam unit 11 releases the tilt lever 3 and the nose 8 rises into contact with the check lever 9 (FIG. 6).

The needle selection device described above operates as follows:

Upon movement of the carriage over the needle bed 2 the tilt levers 3 and the check levers 9 initially, according to choice, adopt the position shown in FIG. 4 or the position shown in FIG. 6. Upon the further movement of the carriage, the tilt levers 3 have their butts 13 engaged by the pressure cam unit 11 and are pivoted into the needle bed 2. By means of the cam unit 21, the check levers 9 which are in the release position (FIG. 4) are pivoted forwards into the blocking position in which they are held by the action of the permanent magnets 18, 19 which are aligned with the lower lever arms 20. One then has the position of the individual components as illustrated in FIG. 1. If now at any given selection position a knitting needle 6 is chosen as a needle which should be non-operational, then the electromagnet 23 is energised for a short time, whereby the lower lever arm 20 of the corresponding check lever 9 is repelled and this check lever is pivoted into its release position, in which position it is held by permanent magnets 15,16, as is shown in FIG. 5. After the release of the butt 13 from the pressure cam unit 11, the lever arm 7 of the associated tilt lever 3 can then pivot upwards under the action of the flexible needle shank 5, and the butt 14 of the knitting needle 6 disappears down into the needle bed, so that it is then not engaged by the needle cam unit.

If on the other hand at a particular selection position a knitting needle 6 is chosen as one to be operational, then the electromagnet 23 is not energised, the associated check lever 9 remains in its blocking position in which it is held by the permanent magnets 18 and 19 acting on its lower lever arm 20, and the lever arm 7 of the tilt lever 3 can then, after release of the butt 13 from the pressure cam unit 11, only pivot up into a position in which the nose 8 lies against the check lever 9 which is in its blocking position, as is shown in FIG. 6. Consequently, the tilt lever 3 remains in a pivoted position in which it holds the needle shank 5 of the knitting needle 6 up high, so that the needle butt 14 can be struck by the advancing needle cam unit and the knitting needle 6 will then be functional.

If on the other hand the choice of a knitting needle 6 to be operational is to be carried out directly at the selection position by energisation of the electromagnet 23, then the electromagnet 23 with its pole shoes 24 is mounted on the carriage in such a way that by its action upon energisation the check levers 9 are pivoted into the blocking position. The cam units 21 and 22 for their part must then be mounted on the carriage so that as they advance they pivot the check levers 9 always into the release position.

In FIGS. 7 to 10 there are shown various alternative arrangements for the construction and positioning of the permanent magnets and electromagnet of the needle selection device. The electromagnet 23 which pivots the check levers 9 at the selection positions here not only has pole shoes 24 between the permanent magnets 18 and 19 which act on the lower lever arms 20 but has additional pole shoes 25 between the permanent magnets 15 and 16 which act on the upper lever arms 17 of the check levers 9. Additionally, the displaceable cam units 21,22 are arranged above instead of next to the permanent magnets 15, 16, and the lever arms of the check levers 9 are correspondingly lengthened. It will also be clearly evident that the check levers 9 are here designed so that they have surfaces in alignment with the pole shoes which, in the positions where they are drawn towards the permanent magnets 15, 16 and 18, 19, lie parallel to the pole shoes of the permanent magnets.

As can be seen particularly clearly from FIGS. 9 and 10, the permanent magnets 15, 16, 18 and 19 are provided with pole shoes 26, 27, 28 and 29 in respective common planes. The permanent magnets lie between the pole shoes; the pole shoes are in the same planes as the pole shoes 24 and 25 of the electromagnet 23. The electromagnet is energised by the switching on of two energising coils 32 and 33 arranged on respective yokes 30 and 31 in such a way that the lower lever arm 20 of the check lever 9 is repelled and, simultaneously, the upper lever arm 17 of the check lever 9 is attracted. In this way one achieves an improved utilisation of the power of the electromagnet 23.

In the arrangement shown in FIG. 10, the electromagnet 23 has a further yoke 34 around which a further energising coil 35 is positioned. Additional pole shoes 36 are constructed and arranged in such a way that the end faces of the check lever 9 are moved between them, and the check lever 9, upon switching on the energising coil 35, is drawn into the release position represented in FIG. 9 by a solid line. The additional energising coil 35 with its magnetic core construction therefore supplements the action of the energising coils 32 and 33.

I claim:

1. A needle selection device for a flat knitting machine equipped with jacquard mechanism in which knitting needles are pivoted in controlled manner into various positions for needle displacement with the aid of cam means on the carriage, the selection device comprising double-armed pivotable check levers of magnetically conductive material associated with the respective needle channels and arranged spaced along the length of the needle bed substantially perpendicular to the needle bed, cam means displaceably mounted on the carriage for pivoting the check levers each into a first position, electromagnet means on the carriage for pivoting the check levers each into a second position at respective selection positions, wherein the setting of each check lever determines the pivot position of the associated knitting needle, and permanent magnet means arranged on the carriage in alignment with the two lever arms of the check levers, in which said permanent magnet means comprises four permanent magnets arranged in pairs each with two poles spaced in the direction of travel of the carriage with an intermediate space between the poles in the direction of travel of the carriage, in which the check levers are held by the permanent magnets in one of said first and second pivot positions, and in which the electromagnet means is constructed and arranged such that it has pole shoes arranged at least on one lever arm side of the check levers in said intermediate space between the poles of the corresponding permanent magnets.

2. A needle selection device according to claim 1, in which the electromagnet means is constructed and arranged such that it has pole shoes arranged on both lever arm sides of the check levers between pole shoes of the permanent magnets.

3. A needle selection device according to claim 2, in which the lever arms of the check levers are constructed in such a way that they have surfaces confronting said permanent magnet pole shoes and extending parallel to the opposing surfaces of the permanent magnet pole shoes in the position of the check levers where they are attracted to the permanent magnets.

4. A needle selection device according to claim 1, in which the electromagnet means is provided with two yokes arranged one inwardly of the other, and with each yoke having its own energising coil.

5. A needle selection device according to claim 4, in which the electromagnet means is provided with a further yoke, on which is arranged a further energising coil and which defines additional pole shoes between which the end surfaces of the check levers move.

6. A needle selection device according to claim 1, in which the check levers are pivotable into their release position by the electromagnet means.

7. A needle selection device according to claim 1, in which the check levers are pivotable into their blocking position by the electromagnet means.

* * * * *